US010011803B2

(12) United States Patent
Taribagil et al.

(10) Patent No.: US 10,011,803 B2
(45) Date of Patent: Jul. 3, 2018

(54) VISCOSITY INDEX IMPROVER CONCENTRATES

(71) Applicant: Infineum International Limited, Abingdon (GB)

(72) Inventors: Rajiv R. Taribagil, Edison, NJ (US); Stuart A. Taylor, Reading (GB); Stuart Briggs, Edison, NJ (US); Laurent Chambard, Englewood, NJ (US)

(73) Assignee: INFINEUM INTERNATIONAL LIMITED (GB)

( * ) Notice: Subject to any disclaimer, the term of this patent is extended or adjusted under 35 U.S.C. 154(b) by 123 days.

(21) Appl. No.: 14/963,477

(22) Filed: Dec. 9, 2015

(65) Prior Publication Data

US 2017/0166830 A1 Jun. 15, 2017

(51) Int. Cl.
*C10M 143/12* (2006.01)
*C10M 143/10* (2006.01)
(Continued)

(52) U.S. Cl.
CPC ..... *C10M 169/02* (2013.01); *C10M 101/02* (2013.01); *C10M 105/32* (2013.01);
(Continued)

(58) Field of Classification Search
CPC ..... C10M 2205/04; C10M 2205/06; C10M 2203/1025; C10M 169/02; C10M 143/12;
(Continued)

(56) References Cited

U.S. PATENT DOCUMENTS 3,113,986 A 12/1963 Breslow
RE27,145 E 6/1971 Jones
(Continued)

FOREIGN PATENT DOCUMENTS

WO WO-98/13443 A1 4/1998
WO WO-99/21902 A1 5/1999

OTHER PUBLICATIONS

Polymer Solutions: An Introduction to Physical Properties Iwao Teraoka (2000)(pp. 1-332).*
(Continued)

*Primary Examiner* — Pamela H Weiss

(57) ABSTRACT

A viscosity index improver containing, in diluent oil, one or more optionally functionalized linear block copolymers having at least one block derived from alkenyl arene covalently linked to at least one block derived from diene in an amount that is greater than the critical overlap concentration ($c_h$*), in mass %, for the linear block copolymers in the diluent oil; and ester base stock and/or at least one star (or radial) polymer, the star polymer being present in an amount such that the $c/c_h$* value of the star polymer in the concentrate falls within the range of from 0.01 to about 1.6, wherein c is the concentration in mass % of star polymer in the concentrate and $c_h$* is the critical overlap concentration in mass % for the star polymer in the diluent oil used to form the concentrate.

14 Claims, 1 Drawing Sheet

(51) Int. Cl.

| | |
|---|---|
| ***C10M 123/04*** | (2006.01) |
| ***C10M 119/00*** | (2006.01) |
| ***C10M 169/02*** | (2006.01) |
| ***C10M 101/02*** | (2006.01) |
| ***C10M 105/32*** | (2006.01) |
| ***C10M 119/02*** | (2006.01) |
| ***C10M 119/24*** | (2006.01) |
| ***C10M 169/04*** | (2006.01) |

(52) U.S. Cl.
CPC ..... *C10M 119/02* (2013.01); *C10M 119/24* (2013.01); *C10M 143/12* (2013.01); *C10M 169/041* (2013.01); *C10M 2205/06* (2013.01); *C10M 2207/2835* (2013.01); *C10N 2220/027* (2013.01); *C10N 2220/029* (2013.01); *C10N 2230/02* (2013.01); *C10N 2270/02* (2013.01)

(58) Field of Classification Search
CPC ..... C10M 169/041; C10M 119/24; C10M 119/02; C10M 105/32; C10M 101/02; C10M 2207/2835; C10N 2220/022; C10N 2220/027; C10N 2230/02; C10N 2270/02; C10N 2220/029
See application file for complete search history.

(56) References Cited

U.S. PATENT DOCUMENTS

| | | | | |
|---|---|---|---|---|
| 3,670,054 | A | 6/1972 | De La Mare et al. | |
| 3,700,633 | A | 10/1972 | Wald | |
| 3,985,830 | A | 10/1976 | Fetters et al. | |
| 4,116,917 | A | 9/1978 | Eckert | |
| 4,146,489 | A | 3/1979 | Stambaugh et al. | |
| 4,216,131 | A | 8/1980 | Himes et al. | |
| 4,292,414 | A | 9/1981 | Saito et al. | |
| 4,506,056 | A | 3/1985 | Gaylord | |
| 4,877,836 | A | 10/1989 | Rhodes | |
| 5,141,996 | A | 8/1992 | Zon et al. | |
| 6,232,279 | B1 * | 5/2001 | Steigerwald | C10M 169/044 508/591 |
| 2012/0157364 | A1 * | 6/2012 | Kelley | C10M 143/00 508/591 |
| 2013/0165362 | A1 * | 6/2013 | Oberoi | C08L 15/00 508/591 |
| 2015/0184105 | A1 | 7/2015 | Taribagil et al. | |

OTHER PUBLICATIONS

"Overlap Concentration of Macromolecules in Solution" Qicong Ying and Benjamin Chu Macromolecules 1987 20, 362-366.*

"Chain overlap and Entanglements in dilute polymer solutions: Brownian dynamics simulation" Macromol. Theory Simul 4, 745-758 (1995).*

"How Polymers Behave as Viscosity index Improvers in Lubricating Oils" Michael J Covitch and Kieran J Trickett (published Mar. 24, 2015) Advances in Chemical Engineering and Science 2015 5, 134-151.*

T Cosgrove and P. C. Griffiths, "The critical overlap concentration measured by pulsed field gradient nuclear magnetic resonance techniques", Polymer, Elsevier Science Publishers B.V., GB, vol. 35, No. 3, Feb. 1, 1994, pp. 509-513, XP022826688, ISSN: 0032-3861.

American Petroleum Institute, Engine Oil Licensing and Certification System, Industry Services Dept., Fourteenth Edition, Dec. 1996, Addendum 1, Dec. 1998.

* cited by examiner

VISCOSITY INDEX IMPROVER CONCENTRATES

FIELD OF THE INVENTION

The invention is directed to viscosity index improver concentrates useful in the formulation of lubricating oil compositions. More specifically, the present invention is directed to viscosity index improver concentrates having improved flow properties at increased polymer concentrations, which concentrates comprise, in diluent oil, one or more linear block copolymers having at least one block derived from alkenyl arene covalently linked to at least one block derived from diene in an amount that is greater than the critical overlap concentration ($c_h$*), in mass %, for the linear block copolymers in the diluent oil; together with (i) at least one star (or radial) polymer, the star polymer being present in an amount such that the $c/c_h$* value of the star or radial polymer in the concentrate falls within the range of from 0.01 to about 1.6, wherein c is the concentration in mass % of star polymer in the concentrate and $c_h$* is the critical overlap concentration in mass % for the star polymer in the diluent oil of the concentrate; and/or (ii) greater than 1 mass %, based on the total mass of the concentrate, of ester base stock.

BACKGROUND OF THE INVENTION

Lubricating oil compositions for use in crankcase engine oils comprise a major amount of base stock oil and minor amounts of additives that improve the performance and increase the useful life of the lubricant. Crankcase lubricating oil compositions conventionally contain polymeric components that are used to improve the viscometric performance of the engine oil, i.e., to provide multigrade oils such as SAE 5W-30, 10W-30 and 10W-40. These viscosity performance enhancers, commonly referred to as viscosity index (VI) improvers, include olefin copolymers, polymethacrylates, alkenyl arene/hydrogenated diene block and star copolymers and hydrogenated idiene linear and star polymers. From an optimized performance/minimized cost perspective, linear alkenyl arene/hydrogenated diene block copolymer VI improvers are favored by many lubricating oil blenders.

VI improvers are commonly provided to lubricating oil blenders as a concentrate in which the VI improver polymer is diluted in oil to allow, inter alia, for dissolution of the VI improver in the base stock oil. Linear alkenyl arene/hydrogenated diene block copolymer VI improver concentrates usually have lower active polymer concentrations and present greater handleability issues compared to star copolymer or olefin copolymer concentrates. Functionalization of the linear the alkenyl arene/hydrogenated diene block copolymer further exacerbates the handleability issues. A typical linear styrene/hydrogenated diene block copolymer VI improver concentrate may contain as little as 3 mass % active polymer (with the remainder being diluent oil), as higher concentrations of these polymers results in a reduction in the flowability of the concentrates at temperatures at which lubricants are blended. A typical formulated multigrade crankcase lubricating oil may, depending on the thickening efficiency (TE) of the polymer, require as much as 3 mass % of active VI improver polymer. An additive concentrate providing this amount of polymer can introduce as much as 20 mass %, based on the total mass of the finished lubricant, of diluent oil.

As the additive industry is highly competitive from a pricing standpoint, and diluent oil represents one of the largest raw material costs to the additive manufacturers, VI improver concentrates have commonly contained the least expensive oil capable of providing suitable handling characteristics; usually a solvent neutral (SN) 100 or SN150 Group I oil. Using such conventional VI improver concentrates, the finished lubricant formulator has needed to add a quantity of relatively high quality base stock oil (Group II or higher) as a correction fluid to insure the viscometric performance of the formulated lubricant remains within specification.

As lubricating oil performance standards have become more stringent, there has been a continuing need to identify components capable of conveniently and cost effectively improving overall lubricant performance. Therefore, it would be advantageous to be able to provide a linear alkenyl arene/hydrogenated diene block copolymer VI improver concentrate that has an increased active polymer concentration while maintaining acceptable flow properties at temperatures at which lubricants are typically blended.

SUMMARY OF THE INVENTION

The flow properties of a polymer concentrate in diluent oil can be assessed by "Tan δ", or "loss tangent", which is defined as the ratio of viscous (liquid-like) response to elastic (solid-like) response. When a material behaves like a liquid, Ln(Tan δ)>>0; when a material behaves like a solid, Ln(Tan δ)<<0. A polymer concentrate having high Ln(Tan δ) values, preferably Ln(Tan δ) values ≥1, have good flowability or handleability properties. Concentrates of linear block copolymers having at least one block derived from alkenyl arene covalently linked to at least one block derived from diene will display a predominantly elastic response when the polymer concentration is greater than the polymers critical overlap concentration (about 1 mass % to about 2.5 mass %); the concentration at above which the polymers significantly entangle (possibly due, at least in part, to the aggregation of the alkenyl arene-derived blocks of the copolymer chains), resulting in a reduction in the flow properties of the concentrate. The functionalization of these polymers with ester, amine, imide or amide functional groups to provide a multifunctional dispersant viscosity modifier (or DVM) further negatively impacts the handleability of the polymer concentrates.

In general, the introduction of additional polymer (any polymer) to the polymer concentrate would be expected to increase the viscosity of the concentrate. However, it has now been found that higher concentrations of linear block copolymers having at least one block derived from alkenyl arene covalently linked to at least one block derived from diene can be dissolved in diluent oil to form a polymer concentrate having acceptable flow properties at temperatures at which these polymer concentrates are conventionally blended into finished lubricants (about 25 to about 140° C.) by further including in the concentrate, a minor amount of a star (or radial) polymer and/or an amount of ester base stock.

In accordance with a first aspect of the invention, there is provided a viscosity index improver (VI) concentrate comprising, in diluent oil, one or more linear block copolymers having at least one block derived from alkenyl arene covalently linked to at least one block derived from diene in an amount that is greater than the critical overlap concentration ($c_h$*), in mass %, for the linear block copolymers in the diluent oil (e.g., greater than 3 mass %); and at least one star (or radial) polymer, the star polymer being present in an amount such that the $c/c_h^*$ value of the star polymer in the concentrate falls within the range of from 0.01 to about 1.6, wherein c is the concentration in mass % of star polymer in the concentrate and $c_h^*$ is the critical overlap concentration in mass % for the star polymer in the diluent oil used to form the concentrate.

In accordance with a second aspect of the invention, there is provided a VI improver concentrate, as in the first aspect, wherein the diene blocks and/or alkenyl arene blocks of said linear block copolymers are functionalized to have pendant ester, amine, imide or amide functional groups.

In accordance with a third aspect of the invention, there is provided a VI improver concentrate, as in the first or second aspect, wherein the concentrate further comprises greater than 1 mass %, such as from about 5 mass % to about 60 mass %, based on the total mass of the concentrate, of ester base stock.

In accordance with fourth aspect of the invention, there is provided a VI improver concentrate, as in the first, second or third aspect, wherein said VI improver concentrate consists essentially of diluent oil, one or more linear block copolymers having at least one block derived from alkenyl arene covalently linked to at least one block derived from diene; at least one star polymer; and optionally, polyol ester.

In accordance with a fifth aspect of the invention, there is provided a VI improver concentrate, as in the first, second, third or fourth aspect, wherein at least one of said star polymer comprises multiple block copolymer arms having at least one block derived from alkenyl arene covalently linked to at least one block derived from diene.

In accordance with a sixth aspect of the invention, there is provided a VI improver concentrate, as in the first, second, third fourth or fifth aspect, wherein said star polymer is functionalized to have pendant ester, amine, imide or amide functional groups.

In accordance with a seventh aspect of the invention, there is provided a VI improver concentrate, as in the first, second, third, fourth, fifth or sixth aspect, wherein the concentrate has a kinematic viscosity at 100° C. ($kv_{100}$) of from about 300 to about 2500 cSt.

In accordance with an eighth aspect of the invention, there is provided a method of increasing the amount of one or more linear block copolymer having at least one block derived from alkenyl arene covalently linked to at least one block derived from diene that can be dissolved in diluent oil in the formation of a VI improver concentrate to an amount greater than the critical overlap concentration ($c_h^*$), in mass %, for the linear block copolymers in the diluent oil, without raising the kinematic viscosity at 100° C. ($kv_{100}$) of the VI improver concentrate above about 3000 cSt, which method comprises adding to said concentrate at least one star (or radial) polymer, the star polymer being added in an amount such that the $c/c_h^*$ value of the star polymer in the concentrate falls within the range of from 0.01 to about 1.6, wherein c is the concentration in mass % of star polymer in the concentrate and $c_h^*$ is the critical overlap concentration in mass % for the star polymer in the diluent oil used to form the concentrate.

In accordance with a ninth aspect of the invention, there is provided a method, as in the eighth aspect, wherein greater than 1 mass %, such as from about 5 mass % to about 60 mass %, of a polyol ester is present in, or added to said VI improver concentrate.

In accordance with a tenth aspect of the invention, there is provided a method, as in the eighth or ninth aspect, wherein at least one of said star polymer comprises multiple block copolymer arms having at least one block derived from alkenyl arene covalently linked to at least one block derived from diene.

In accordance with an eleventh aspect of the invention, there is provided a method, as in the eighth, ninth or tenth aspect, wherein said star polymer is functionalized to have pendant ester, amine, imide or amide functional groups.

In accordance with a twelfth aspect of the invention, there is provided the use of an amount of at least one star (or radial) polymer to increase the amount of one or more linear block copolymers having at least one block derived from alkenyl arene covalently linked to at least one block derived from diene that can dissolved in diluent oil in the formation of a VI improver concentrate to greater than the critical overlap concentration ($c_h^*$), in mass %, for the linear block copolymers in the diluent oil, without raising the kinematic viscosity at 100° C. ($kv_{100}$) of the VI improver concentrate above about 3000 cSt; the amount of star polymer being such that the $c/c_h^*$ value of the star polymer in the concentrate falls within the range of from 0.01 to about 1.6, wherein c is the concentration in mass % of star polymer in the concentrate and $c_h^*$ is the critical overlap concentration in mass % for the star polymer in the diluent oil used to form the concentrate.

In accordance with a thirteenth aspect of the invention, there is provided the use an amount of at least one star (or radial) polymer and an amount of ester base stock, to increase the amount of one or more linear block copolymers having at least one block derived from alkenyl arene covalently linked to at least one block derived from diene that can dissolved in diluent oil in the formation of a VI improver concentrate to greater than the critical overlap concentration ($c_h^*$), in mass %, for the linear block copolymers in the diluent oil, without raising the kinematic viscosity at 100° C. ($kv_{100}$) of the VI improver concentrate above about 3000 cSt, the amount of ester base stock in the concentrate being greater than 1 mass %, such as from about 5 mass % to about 60 mass %, based on the total mass of said VI improver concentrate.

In accordance with a fourteenth aspect of the invention, there is provided the use of an amount of at least one star polymer, as in the twelfth or thirteenth aspect, wherein at least one of said star polymer comprises multiple block copolymer arms having at least one block derived from alkenyl arene covalently linked to at least one block derived from diene.

In accordance with a fifteenth aspect of the invention, there is provided the use an amount of star polymer, as in the twelfth, thirteenth or fourteenth aspect, wherein said star polymer are functionalized to have pendant ester, amine, imide or amide functional groups.

In accordance with a sixteenth aspect of the invention, there is provided a viscosity index improver (VI) concentrate comprising, in diluent oil, an amount of one or more linear block copolymers having at least one block derived from alkenyl arene, covalently linked to at least one block derived from diene, wherein the diene blocks and/or alkenyl arene blocks of at least one of said linear block copolymers are functionalized to have pendant ester, amine, imide or amide functional groups, which amount is greater than the critical overlap concentration ($c_h^*$), in mass %, for the linear block copolymers in the diluent oil; and greater than 1 mass %, such as from about 5 mass % to about 60 mass %, based on the total mass of the concentrate, of ester base stock.

In accordance with a seventeenth aspect of the invention, there is provided a VI improver concentrate, as in the sixteenth aspect, wherein said VI improver concentrate consists essentially of the functionalized polymer, diluent oil and ester base stock.

In accordance with an eighteenth aspect of the invention, there is provided a method of increasing the amount of one or more linear block copolymer having at least one block derived from alkenyl arene covalently linked to at least one block derived from diene, wherein the diene blocks and/or alkenyl arene blocks of at least one of said linear block copolymers are functionalized to have pendant ester, amine, imide or amide functional groups, that can be dissolved in diluent oil in the formation of a VI improver concentrate to greater than the critical overlap concentration ($c_h$*), in mass %, for the linear block copolymers in the diluent oil, without raising the kinematic viscosity at 100° C. ($kv_{100}$) of the VI improver concentrate above about 3000 cSt, which method comprises adding to said concentrate greater than 1 mass %, such as from about 5 mass % to about 60 mass %, based on the total mass of the concentrate, of ester base stock.

In accordance with a nineteenth aspect of the invention, there is provided the use of an amount of ester base stock to increase the amount of one or more linear block copolymer having at least one block derived from alkenyl arene covalently linked to at least one block derived from diene wherein the diene blocks and/or alkenyl arene blocks of at least one of said linear block copolymers are functionalized to have pendant ester, amine, imide or amide functional groups, that can be dissolved in diluent oil in the formation of a VI improver concentrate to an amount greater than the critical overlap concentration ($c_h$*), in mass %, for the linear block copolymers in the diluent oil, without raising the kinematic viscosity at 100° C. ($kv_{100}$) of the VI improver concentrate above about 3000 cSt, the ester base stock being present in the concentrate in an amount greater than 1 mass %, such as from about 5 mass % to about 60 mass %, based on the total mass of said VI improver concentrate.

Other and further objects, advantages and features of the present invention will be understood by reference to the following specification.

DETAILED DESCRIPTION OF THE FIGURES

DETAILED DESCRIPTION OF THE INVENTION

Figure 1:
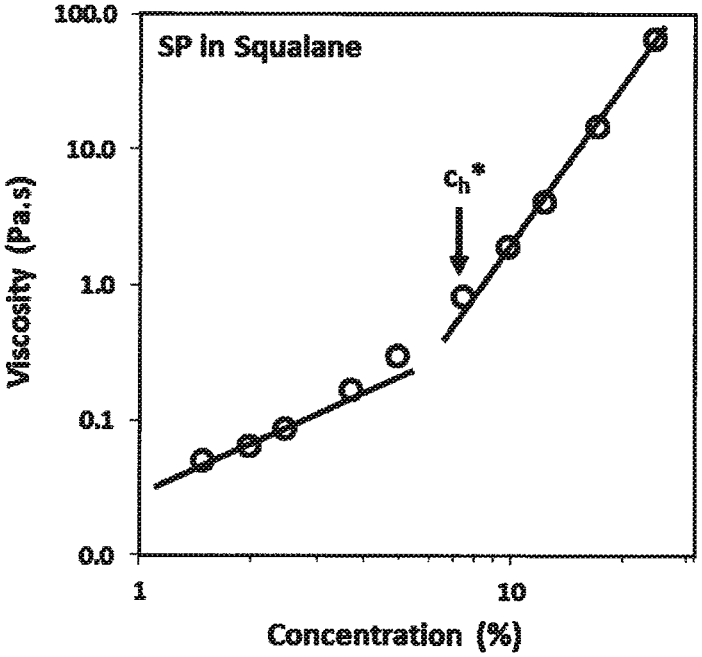
FIG. 1 shows the viscosity vs. concentration profile (log-log plot) of a star polymer having hydrogenated polydiene arms in squalane solution at 40° C.

The linear block copolymers of the present invention have at least one block derived primarily from one or more alkenyl arene containing from 8 to about 16 carbon atoms such as alkyl-substituted styrenes, alkoxy-substituted styrenes, vinyl naphthalene, alkyl-substituted vinyl naphthalenes and the like, covalently linked to at least one block derived primarily from one or more diolefins or dienes containing from 4 to about 12 carbon atoms, such as 1,3-butadiene, isoprene, piperylene, methylpentadiene, phenylbutadiene, 3,4-dimethyl-1,3-hexadiene, 4,5-diethyl-1,3-octadiene. These linear block copolymers may be represented by the following general formula:

$$A_z—(B—A)_y—B_x$$

wherein:

A is a polymeric block comprising predominantly alkenyl arene monomer units;

B is a polymeric block comprising predominantly conjugated diene or diolefin monomer units;

x and z are, independently, a number equal to 0 or 1; and y is a whole number ranging from 1 to about 15.

As used herein in connection with polymer block composition, predominantly means that the specified monomer or monomer type which is the principle component in that polymer block is present in an amount of at least 85% by mass of the block.

Preferably, the linear block copolymers of the present invention are di- or tri-block copolymers having a single derived primarily from one or more alkenyl arene, covalently linked to one block or two blocks derived primarily from one or more diolefins or dienes. Preferably, the block derived primarily from one or more alkenyl arene is derived primarily from alkyl-substituted styrene. Preferably the block(s) derived primarily from one or more diolefins or dienes are derived primarily from butadiene, isoprene, or a mixture thereof. Isoprene monomers that may be used as the precursors of the copolymers of the present invention can be incorporated into the polymer as either 1,4- or 3,4-configuration units, and mixtures thereof. Preferably, the majority of the isoprene is incorporated into the polymer as 1,4-units, such as greater than about 60 mass %, more preferably greater than about 80 mass %, such as about 80 to 100 mass %, most preferably greater than about 90 mass %, such as about 93 mass % to 100 mass %. Butadiene monomers that may be used as the precursors of the copolymers of the present invention can also be incorporated into the polymer as either 1,2- or 1,4-configuration units. Preferably, in polymers of the present invention in which butadiene is copolymerized with another diene (e.g., isoprene), at least about 70 mass %, such as at least about 75 mass %, more preferably at least about 80 mass %, such as at least about 85 mass %, most preferably at least about 90, such as 91 to 100 mass % of the butadiene is incorporated into the polymer as 1,4-configuration units.

Polymers prepared with diolefins will contain ethylenic unsaturation, and such polymers are preferably hydrogenated. When the polymer is hydrogenated, the hydrogenation may be accomplished using any of the techniques known in the prior art. For example, the hydrogenation may be accomplished such that both ethylenic and aromatic unsaturation is converted (saturated) using methods such as those taught, for example, in U.S. Pat. Nos. 3,113,986 and 3,700,633 or the hydrogenation may be accomplished selectively such that a significant portion of the ethylenic unsaturation is converted while little or no aromatic unsaturation is converted as taught, for example, in U.S. Pat. Nos. 3,634,595; 3,670,054; 3,700,633 and Re 27,145. Any of these methods can also be used to hydrogenate polymers containing only ethylenic unsaturation and which are free of aromatic unsaturation.

The linear block copolymers of the present invention may include mixtures of linear polymers as disclosed above, but having different molecular weights and/or different alkenyl aromatic contents. The use of two or more different polymers may be preferred to a single polymer depending on the rheological properties the product is intended to impart when used to produce formulated engine oil.

The linear block copolymers of the present invention will have number average molecular weights between about 5,000 and about 700,000 daltons;

preferably between about 10,000 and about 500,000 daltons; more preferably between about 20,000 and about 250,000 daltons. Preferably, between about 5% and about 60%, more preferably, between about 25% and about 55% by mass of the linear block copolymers of the present invention is derived from alkenyl arene. The term "weight average molecular weight", as used herein, refers to the weight average molecular weight as measured by Gel Permeation Chromatography ("GPC") with a polystyrene standard, subsequent to hydrogenation.

The linear block copolymers of the present invention include those prepared in bulk, suspension, solution or emulsion. As is well known, polymerization of monomers to produce hydrocarbon polymers may be accomplished using free-radical, cationic and anionic initiators or polymerization catalysts, such as transition metal catalysts used for Ziegler-Natta and metallocene type catalysts. Preferably, the block copolymers of the present invention are formed via anionic polymerization as anionic polymerization has been found to provide copolymers having a narrow molecular weight distribution (Mw/Mn), such as a molecular weight distribution of less than about 1.2.

As is well known, and disclosed, for example, in U.S. Pat. No. 4,116,917, living polymers may be prepared by anionic solution polymerization of a mixture of the conjugated diene monomers in the presence of an alkali metal or an alkali metal hydrocarbon, e.g., sodium naphthalene, as anionic initiator. The preferred initiator is lithium or a monolithium hydrocarbon. Suitable lithium hydrocarbons include unsaturated compounds such as allyl lithium, methallyl lithium; aromatic compounds such as phenyllithium, the tolyllithiums, the xylyllithiums and the naphthyllithiums, and in particular, the alkyl lithiums such as methyllithium, ethyllithium, propyllithium, butyllithium, amyllithium, hexyllithium, 2-ethylhexyllithium and n-hexadecyllithium. Secondary-butyllithium is the preferred initiator. The initiator(s) may be added to the polymerization mixture in one or more stages, optionally together with additional monomer. The living polymers are olefinically unsaturated.

Optionally, the linear block copolymers of the present invention can be provided with ester- or nitrogen-containing functional groups that impart dispersant capabilities to the VI improver. More specifically, the diene blocks and/or alkenyl arene blocks of the linear block copolymers of the present invention can be provided with pendant carbonyl-containing groups functionalized to provide an ester, amine, imide or amide functionality; and/or the diene block(s) of the linear block copolymers of the present invention can be functionalized with an amine functionality bonded directly onto the diene block. Processes for the grafting of a nitrogen-containing moiety onto a polymer are known in the art and include, for example, contacting the polymer and nitrogen-containing moiety in the presence of a free radical initiator, either neat, or in the presence of a solvent. The free radical initiator may be generated by shearing (as in an extruder) or heating a free radical initiator precursor. Methods for grafting nitrogen-containing monomer onto polymer backbones, and suitable nitrogen-containing grafting monomers are further described, for example, in U.S. Pat. No. 5,141,996, WO 98/13443, WO 99/21902, U.S. Pat. No. 4,146,489, U.S. Pat. No. 4,292,414, and U.S. Pat. No. 4,506,056. (See also *J Polymer Science,* Part A: Polymer Chemistry, Vol. 26, 1189-1198 (1988); *J. Polymer Science,* Polymer Letters, Vol. 20, 481-486 (1982) and *J. Polymer Science,* Polymer Letters, Vol. 21, 23-30 (1983), all to Gaylord and Mehta and *Degradation and Cross-linking of Ethylene-Propylene Copolymer Rubber on Reaction with Maleic Anhydride and/or Peroxides; J. Applied Polymer Science,* Vol. 33, 2549-2558 (1987) to Gaylord, Mehta and Mehta. Examples of suitable nitrogen-containing moieties from which nitrogen-containing functional groups can be derived include aliphatic amine, aromatic amine and non-aromatic amine, particularly wherein the amine comprises a primary or secondary nitrogen group. Preferably, functionalization is provided by amines selected from aniline, diethylamino propylamine, N,N-dimethyl-p-phenylenediamine, 1-naphthylamine, N-phenyl-p-phenylenediamine (also known as 4-aminodiphenyl-amine or ADPA), N-(3-aminopropyl)imidazole, N-(3-aminopropyl)morpholine, m-anisidine, 3-amino-4-methylpyridine, 4-nitroaniline, and combinations thereof.

The amount of nitrogen-containing grafting monomer will depend, to some extent, on the nature of the substrate polymer and the level of dispersancy required of the grafted polymer. To impart dispersancy characteristics to the linear copolymers, the amount of grafted nitrogen-containing monomer is suitably between about 0.3 and about 2.2 mass %, preferably from about 0.5 to about 1.8 mass %, most preferably from about 0.6 to about 1.2 mass %, based on the total weight of grafted polymer.

Star, or radial polymers useful in the practice of the invention include homopolymers and copolymers of diolefins containing from 4 to about 12 carbon atoms, such as 1,3-butadiene, isoprene, piperylene, methylpentadiene, phenylbutadiene, 3,4-dimethyl-1,3-hexadiene, 4,5-diethyl-1,3-octadiene, and copolymers of one or more conjugated diolefins and one or more monoalkenyl aromatic hydrocarbons containing from 8 to about 16 carbon atoms such as aryl-substituted styrenes, alkoxy-substituted styrenes, vinyl naphthalene, alkyl-substituted vinyl naphthalenes and the like. Such polymers and copolymers include random polymers, tapered polymers and block copolymers.

A star polymer can be produced by reacting living polymers formed via the foregoing anionic solution polymerization process, in an additional reaction step, with a polyalkenyl coupling agent. Polyalkenyl coupling agents capable of forming star polymers have been known for a number of years and are described, for example, in U.S. Pat. No. 3,985,830. Polyalkenyl coupling agents are conventionally compounds having at least two non-conjugated alkenyl groups. Such groups are usually attached to the same or different electron-withdrawing moiety e.g. an aromatic nucleus. Such compounds have the property that at least one of the alkenyl groups are capable of independent reaction with different living polymers and in this respect are different from conventional conjugated diene polymerizable monomers such as butadiene, isoprene, etc. Pure or technical grade polyalkenyl coupling agents may be used. Such compounds may be aliphatic, aromatic or heterocyclic. Examples of aliphatic compounds include the polyvinyl and polyallyl acetylene, diacetylenes, and phosphates as well as dimethacrylates, e.g. ethylene dimethylacrylate. Examples of suitable heterocyclic compounds include divinyl pyridine and divinyl thiophene.

The preferred coupling agents are the polyalkenyl aromatic compounds and most preferred are the polyvinyl aromatic compounds. Examples of such compounds include those aromatic compounds, e.g. benzene, toluene, xylene, anthracene, naphthalene and durene, which are substituted with at least two alkenyl groups, preferably attached directly thereto. Specific examples include the polyvinyl benzenes, e.g. divinyl, trivinyl and tetravinyl benzenes; divinyl, trivinyl and tetravinyl ortho-, meta- and para-xylenes, divinyl naphthalene, divinyl ethyl benzene, divinyl biphenyl, diisobutenyl benzene, diisopropenyl benzene, and diisopropenyl biphenyl. The preferred aromatic compounds are those represented by the formula A-(CH=$CH_2$)$_x$ wherein A is an optionally substituted aromatic nucleus and x is an integer of at least 2. Divinyl benzene, in particular meta-divinyl benzene, is the most preferred aromatic compound. Pure or technical grade divinyl benzene (containing other monomers e.g. styrene and ethyl styrene) may be used. The coupling agents may be used in admixture with small amounts of added monomers which increase the size of the nucleus, e.g. styrene or alkyl styrene. In such a case, the nucleus can be described as a poly(dialkenyl coupling agent/monoalkenyl aromatic compound) nucleus, e.g. a poly (divinylbenzene/monoalkenyl aromatic compound) nucleus.

The polyalkenyl coupling agent should be added to the living polymer after the polymerization of the monomers is substantially complete, i.e. the agent should be added only after substantially all the monomer has been converted to the living polymers.

The amount of polyalkenyl coupling agent added may vary within a wide range, but preferably, at least 0.5 moles of the coupling agent is used per mole of unsaturated living polymer. Amounts of from about 1 to about 15 moles, preferably from about 1.5 to about 5 moles per mole of living polymer are preferred. The amount, which can be added in one or more stages, is usually an amount sufficient to convert at least about 80 mass % to 85 mass % of the living polymer into star-shaped polymer.

The coupling reaction can be carried out in the same solvent as the living polymerization reaction. The coupling reaction can be carried out at temperatures within a broad range, such as from 0° C. to 150° C., preferably from about 20° C. to about 120° C. The reaction may be conducted in an inert atmosphere, e.g. nitrogen, and under pressure of from about 0.5 bar to about 10 bars.

The star-shaped polymers thus formed are characterized by a dense center or nucleus of crosslinked poly(polyalkenyl coupling agent) and a number of arms of substantially linear unsaturated polymers extending outward from the nucleus. The number of arms may vary considerably, but is typically between about 4 and 25, such as from about 6 to about 22 or from about 8 to about 20, with each arm having a number average molecular weights of between about 10,000 and about 200,000 daltons.

As with the linear block copolymers described above, the star or radial polymers are preferably hydrogenated and may also optionally be provided with ester- or nitrogen-containing functional groups that impart dispersant capabilities to the VI improver. As with the linear block copolymers described above, the star or radial polymer may include mixtures of star polymers having different molecular weights and/or different alkenyl aromatic contents.

In general, star polymers having number average molecular weights of between about 80,000 and about 1,500,000 daltons are acceptable, and between about 350,000 and about 800,000 or 900,000 daltons are preferred. As above, the term "weight average molecular weight", as used herein, refers to the weight average molecular weight as measured by Gel Permeation Chromatography ("GPC") with a polystyrene standard, subsequent to hydrogenation When the star polymer is a copolymer of monoalkenyl arene and polymerized alpha olefins, hydrogenated polymerized diolefins or combinations thereof, the amount of monoalkenyl arene in the star polymer is preferably between about 5% and about 40% by mass, based on the total mass of the polymer.

Ester base stocks useful in the practice of the present invention include those made from $C_5$ to $C_{12}$ monocarboxylic acids and polyols and polyol esters such as neopentyl glycol, trimethylolpropane, pentaerythritol, dipentaerythritol and tripentaerythritol and diesters made from dicarboxylic acids (e.g., phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids) with a variety of alcohols (e.g., butyl alcohol, hexyl alcohol, dodecyl alcohol, 2-ethylhexyl alcohol, ethylene glycol, diethylene glycol monoether, propylene glycol). Examples of such esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid. Preferably, the ester base stock is a polyol ester. The ester base stock, when used, will be present in an amount of greater than 1 mass %, such as from about 5 mass % to 60 mass %, from about 5 mass % to about 40 mass %, from about 5 mass % to about 25 mass % or from about 5 mass % to about 15 mass %, based on the total mass of the concentrate.

Oils of lubricating viscosity useful as the diluents of the present invention may be selected from natural lubricating oils, synthetic lubricating oils and mixtures thereof.

Natural oils include animal oils and vegetable oils (e.g., castor oil, lard oil); liquid petroleum oils and hydro-refined, solvent-treated or acid-treated mineral oils of the paraffinic, naphthenic and mixed paraffinic-naphthenic types. Oils of lubricating viscosity derived from coal or shale also serve as useful base oils.

Synthetic lubricating oils include, in addition to the ester basestocks described supra, hydrocarbon oils and halo-substituted hydrocarbon oils such as polymerized and interpolymerized olefins (e.g., polybutylenes, polypropylenes, propylene-isobutylene copolymers, chlorinated polybutylenes, poly(1-hexenes), poly(1-octenes), poly(1-decenes)); alkylbenzenes (e.g., dodecylbenzenes, tetradecylbenzenes, dinonylbenzenes, di(2-ethylhexyl)benzenes); polyphenyls (e.g., biphenyls, terphenyls, alkylated polyphenols); and alkylated diphenyl ethers and alkylated diphenyl sulfides and derivative, analogs and homologs thereof.

Alkylene oxide polymers and interpolymers and derivatives thereof where the terminal hydroxyl groups have been modified by esterification, etherification, etc., constitute another class of known synthetic lubricating oils. These are exemplified by polyoxyalkylene polymers prepared by polymerization of ethylene oxide or propylene oxide, and the alkyl and aryl ethers of polyoxyalkylene polymers (e.g., methyl-polyiso-propylene glycol ether having a molecular weight of 1000 or diphenyl ether of poly-ethylene glycol having a molecular weight of 1000 to 1500); and mono- and polycarboxylic esters thereof, for example, the acetic acid esters, mixed $C_3$-$C_8$ fatty acid esters and $C_{13}$ Oxo acid diester of tetraethylene glycol.

Silicon-based oils such as the polyalkyl-, polyaryl-, polyalkoxy- or polyaryloxysilicone oils and silicate oils comprise another useful class of synthetic lubricants; such oils include tetraethyl silicate, tetraisopropyl silicate, tetra-(2-ethylhexyl)silicate, tetra-(4-methyl-2-ethylhexyl)silicate, tetra-(p-tert-butyl-phenyl) silicate, hexa-(4-methyl-2-ethylhexyl)disiloxane, poly(methyl)siloxanes and poly(methylphenyl)siloxanes. Other synthetic lubricating oils include liquid esters of phosphorous-containing acids (e.g., tricresyl phosphate, trioctyl phosphate, diethyl ester of decylphosphonic acid) and polymeric tetrahydrofurans.

The diluent oil may comprise a Group I, Group II, Group III, Group IV or Group V oil or blends of the aforementioned oils. The diluent oil may also comprise a blend of a Group I oil and one or more Group II, Group III, Group IV or Group V oil. Preferably, from an economic standpoint, the diluent oil is a mixture of a Group I oil and one or more of a Group II, Group III, Group IV or Group V oil, more preferably a mixture of a Group I oil and one or more Group II and/or Group III oil. From a performance standpoint, the invention is particularly relevant to concentrates in which a majority of the diluent oil, particularly greater than 55 mass %, such as greater than 75 mass %, particularly greater than 80 mass % of the diluent oil is Group III oil, in which block copolymers having at least one block derived from alkenyl arene are less soluble (compared to Group I and Group II diluent oil).

Definitions for the oils as used herein are the same as those found in the American Petroleum Institute (API) publication "Engine Oil Licensing and Certification System", Industry Services Department, Fourteenth Edition, December 1996, Addendum 1, December 1998. Said publication categorizes oils as follows:

a) Group I oils contain less than 90 percent saturates and/or greater than 0.03 percent sulfur and have a viscosity index greater than or equal to 80 and less than 120 using the test methods specified in Table 1.
b) Group II oils contain greater than or equal to 90 percent saturates and less than or equal to 0.03 percent sulfur and have a viscosity index greater than or equal to 80 and less than 120 using the test methods specified in Table 1. Although not a separate Group recognized by the API, Group II oils having a viscosity index greater than about 110 are often referred to as "Group II+" oils.
c) Group III oils contain greater than or equal to 90 percent saturates and less than or equal to 0.03 percent sulfur and have a viscosity index greater than or equal to 120 using the test methods specified in Table 1.
d) Group IV oils are polyalphaolefins (PAO).
e) Group V oils are all other base stocks not included in Group I, II, III, or IV.

TABLE 1

| Property | Test Method |
|---|---|
| Saturates | ASTM D2007 |
| Viscosity Index | ASTM D2270 |
| Sulfur | ASTM D4294 |

Diluent oil useful in the practice of the invention preferably has a CCS at −35° C. of less than 3700 cPs, such as less than 3300 cPs, more preferably less than 3000 cPs, such as less than 2800 cPs and particularly less than 2500 cPs, such as less than 2300 cPs. Diluent oil useful in the practice of the invention also preferably has a kinematic viscosity at 100° C. ($kv_{100}$) of at least 3.0 cSt (centistokes), such as from about 3 cSt. to about 5 cSt., especially from about 3 cSt to about 4.5 cSt, such as from about 3.4 to 4 cSt. The diluent oil preferably has a saturate content of at least 65%, more preferably at least 75%, such as at least 85%. Most preferably, the diluent oil has a saturate content of greater than 90%. Preferably, the diluent oil has a sulfur content of less than 1%, preferably less than 0.6%, more preferably less than 0.3%, by mass, such as 0 to 0.3% by mass. Preferably the volatility of the diluent oil, as measured by the Noack test (ASTM D5880), is less than or equal to about 40%, such as less than or equal to about 35%, preferably less than or equal to about 32%, such as less than or equal to about 28%, more preferably less than or equal to about 16%. Using a diluent oil having a greater volatility makes it difficult to provide a formulated lubricant having a Noack volatility of less than or equal to 15%. Formulated lubricants having a higher level of volatility may display fuel economy debits. Preferably, the viscosity index (VI) of the diluent oil is at least 85, preferably at least 100, most preferably from about 105 to 140.

The VI improver concentrates of the present invention can be prepared by dissolving the VI improver polymer(s) in the diluent oil (and ester base stock, when present) using well known techniques. When dissolving a solid VI improver polymer to form a concentrate, the high viscosity of the polymer can cause poor diffusivity in the diluent oil. To facilitate dissolution, it is common to increase the surface are of the polymer by, for example, pelletizing, chopping, grinding or pulverizing the polymer. The temperature of the diluent oil can also be increased by heating using, for example, steam or hot oil. When the diluent temperature is greatly increased (such as to above 100° C.), heating should be conducted under a blanket of inert gas (e.g., $N_2$ or $CO_2$). The temperature of the polymer may also be raised using, for example, mechanical energy imparted to the polymer in an extruder or masticator. The polymer temperature can be raised above 150° C.; the polymer temperature should be raised under a blanket of inert gas. Dissolving of the polymer may also be aided by agitating the concentrate, such as by stirring or agitating (in either the reactor or in a tank), or by using a recirculation pump. Any two or more of the foregoing techniques can also be used in combination. Concentrates can also be formed by exchanging the polymerization solvent (usually a volatile hydrocarbon such as, for example, propane, hexane or cyclohexane) with oil. This exchange can be accomplished by, for example, using a distillation column to assure that substantially none of the polymerization solvent remains.

As noted above, the VI concentrates of the present invention contain one or more linear block copolymers having at least one block derived from alkenyl arene, covalently linked to at least one block derived from diene in an amount that is greater than the critical overlap concentration ($c_h$*), in mass %, for the linear block copolymers in the diluent oil used to form the concentrate. The critical overlap concentration, which is the concentration at above which the individual polymers significantly entangle, as well as the critical overlap concentration of the star polymer component of the VI concentrate of the present invention can be determined from a log-log plot of viscosity versus concentration, as shown in FIG. 1. Above the critical overlap concentration, viscosity rises more steeply with increasing concentration. For the linear block copolymers of the present invention, in Group I, II and III diluent oils, this critical overlap concentration will usually be about 1.5 mass % to about 2.5 mass %. Where the VI concentrate is to contain ester base stock, the ester base stock should be considered as diluent oil, for purposes of determining the critical overlap concentration of both the linear block copolymer(s) and star polymer(s) of the VI concentrate.

To insure acceptable flowability/handleability at temperatures at which VI improver concentrates are conventionally blended into finished lubricants (about 25 to about 140° C.), the kinematic viscosity at 100° C. ($kv_{100}$) of the VI improver concentrate of the present invention is preferably no greater than about 3000 cSt, such as no greater than about 2500 cSt, preferably no greater than about 2000cSt ($kv_{100}$ as measured in accordance with ASTM D445). Alternatively, flowability/handleability can be expressed in terms of "Tan δ", or "loss tangent", which is defined as the ratio of viscous (liquid-like) response to elastic (solid-like) response, wherein Tan δ for the concentrate is determined by applying a small, sinusoidally oscillating strain to the concentrate in a rheometer of coquette (concentric cylinder), cone and plate, sliding plates or parallel disks geometry. The resulting stress is phase shifted by an amount δ; "loss tangent" is the tangent of this phase angle δ. A handleable VI improver concentrate of the present invention will have a Tan δ of greater or equal 1, preferably greater than or equal to 1.5.

Preferably, the VI concentrates of the present invention contain one or more linear block copolymers having at least one block derived from alkenyl arene, covalently linked to at least one block derived from diene in an amount of greater than 4 mass %, preferably at least 5 mass %, such as about 5 mass % to about 10 mass %, based on the total mass of the concentrate. As the star polymer is being introduced mainly to increase the amount of diblock copolymer that can be incorporated into the concentrate, and not primarily for the viscosity modifying effects of the star polymer, the amount of star polymer incorporated should be close to the minimum amount required to increase the concentration of linear polymer in the concentrate, particularly less than about 5 mass %, such as less than 3 mass %, particularly about 1 mass % to about 2 mass %, based on the total mass of the concentrate. The amount of star polymer necessary is further reduced (or the need for the star polymer may be eliminated) when the VI concentrates of the present invention contain ester base stock.

This invention will be further understood by reference to the following examples.

EXAMPLES

The following were used in the Examples shown below:

DC1—a diblock copolymer having a 25 kDa polystyrene block and a 57 kDa hydrogenated polydiene block (19 mass % butadiene units; 81 mass % isoprene units; >90 mass % 1,4 addition of both dienes);

F-DC1—a functionalized diblock copolymer formed by grafting DC1 with 0.6% maleic anhydride and reacting the anhydride grafts with N-phenyl-p-phenylenediamine;

DC2—a diblock copolymer having a 15 kDa polystyrene block and a 57 kDa hydrogenated polydiene block (100 mass % isoprene units; >90 mass % 1,4 addition of isoprene);

SP—a star polymer having multiple (approximately 15 to 20) arms each formed of hydrogenated isoprene units (≥90 mass % 1,4 addition of isoprene) and having a molecular weight of 35 kDa;

Diluent Oil 1 (D01)—4 cSt. Group III oil;

Ester Base stock (EB)—Priolube 3970, available from Croda Lubricants, 4.4 cSt Group V oil;

Squalane

As shown below in Table 1, the addition of ester base stock and/or star polymer increases the loss tangent value for the diblock concentrate, which is indicative of an improvement in the flowability/handleability of the concentrate, and the ability of the concentrate to remain handleable when the amount of polymer diluted in the concentrate is increased. This benefit is also demonstrated using a functionalized diblock copolymer.

TABLE 1

| Ex. | Concentrate Content | Ln(Tan δ) @ 25° C. |
|---|---|---|
| 1 (Comp.) | 7 mass % DC1 in DO1 | 0.10 |
| 2 (Inv.) | 7 mass % DC1 + 1 mass % SP in DO1 | 1.09 |
| 3 (Comp.) | 7 mass % DCL in DO1/EB (20/80 m/m) | 0.20 |
| 4 (Inv.) | 7 mass % DC1 + 1 mass % SP in DO1/EB (20/80 m/m) | 1.17 |
| 5 (Comp.) | 5 mass % F-DC1 in DO1 | −1.71 |
| 6 (Inv.) | 5 mass % F-DC1 + 1 mass % SP in DO1 | −1.35 |
| 7 (Inv.) | 7 mass % F-DC1 in DO1/EB (50/50 m/m) | −0.34 |
| 8 (Inv.) | 7 mass % F-DC1 + 1 mass % SP in DO1/EB (50/50 m/m) | 0.18 |

Figure 2:
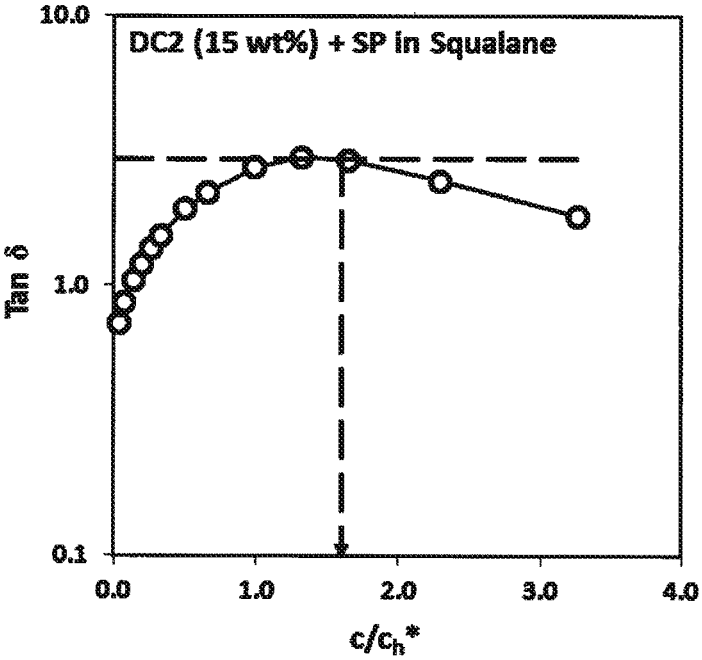
FIG. 2 shows the Tan δ vs. $c/c_h$* profile (semi-log plot) for a linear diblock polystyrene/hydrogenated polydiene copolymer (15 mass %)+star polymer in squalane solution at 40° C.

FIG. 1 shows the concentration dependent viscosity for SP in squalane solution at 40° C. The critical overlap concentration $c_h$* is the point at which the viscosity begins to rise non-linearly with concentration. FIG. 2 shows the Tan δ vs. $c/c_h$* profile for a linear diblock polystyrene/hydrogenated polydiene copolymer (15 mass %)+star polymer in squalane solution at 40° C. The loss tangent for DC-2 (15 mass %)+SP in squalane solution increases with increasing SP content and plateaus at $c/c_h$*=1.60 before starting to decrease. This demonstrates that adding amounts of SP above those needed to achieve a $c/c_h$* value of 1.60 will not further improve the flowability of the tested polymer concentrate.

The disclosures of all patents, articles and other materials described herein are hereby incorporated, in their entirety, into this specification by reference. A description of a composition comprising, consisting of, or consisting essentially of multiple specified components, as presented herein and in the appended claims, should be construed to also encompass compositions made by admixing said multiple specified components. The principles, preferred embodiments and modes of operation of the present invention have been described in the foregoing specification. What applicants submit is their invention, however, is not to be construed as limited to the particular embodiments disclosed, since the disclosed embodiments are regarded as illustrative rather than limiting. Changes may be made by those skilled in the art without departing from the spirit of the invention.

What is claimed is:

1. A viscosity index improver concentrate comprising, in non-ester diluent oil having a saturates content of at least 90%, one or more hydrogenated linear block copolymers having at least one block derived from monoalkenyl arene containing from 8 to about 16 carbon atoms covalently linked to at least one block derived from diene containing from 4 to about 12 carbon atoms in an amount that is greater than the critical overlap concentration ($c_h$*), in mass %, for the linear block copolymers in said diluent oil; and at least one hydrogenated star polymer, arms of which are homopolymers or copolymers of diolefin containing from 4 to about 12 carbon atoms, or copolymers of one or more conjugated diolefin containing from 4 to about 12 carbon atoms and one or more monoalkenyl arena containing from 8 to about 16 carbon atoms; said star polymer being present in an amount such that the $c/c_h$* value of the star polymer in the concentrate falls within the range of from 0.01 to about 1.6, wherein c is the concentration in mass % of said star polymer in said concentrate and $c_h$* is the critical overlap concentration in mass % for said star polymer in said diluent oil; said concentrate having a kinematic viscosity at 100° C. ($kv_{100}$) of from about 300 to about 3000 cSt.

2. A VI improver concentrate of claim 1, wherein the diene blocks and/or alkenyl arene blocks of said linear block copolymers are functionalized to have pendant ester, amine, imide or amide functional groups.

3. A VI improver concentrate of claim 1, further comprising greater than 1 mass %, based on the total mass of the concentrate, of ester base stock.

4. A VI improver concentrate of claim 3, comprising from about 5 mass % to about 60 mass %, based on the total mass of the concentrate, of ester base stock.

5. A VI improver concentrate of claim 2, further comprising greater than 1 mass %, based on the total mass of the concentrate, of ester base stock.

6. A VI improver concentrate of claim 5, comprising from about 5 mass % to about 60 mass %, based on the total mass of the concentrate, of ester base stock.

7. A VI improver concentrate of claim 1, consisting of non-ester diluent oil having a saturates content of at least 90%, one or more of said hydrogenated linear block copolymers; at least one of said star polymer; and optionally, an amount of ester base stock.

8. A VI improver concentrate of claim 2, consisting of non-ester diluent oil having a saturates content of at least 90%, one or more of said hydrogenated linear block copolymers; at least one of said, star polymer; and optionally, an amount of ester base stock.

9. A method of increasing the amount of one or more hydrogenated linear block copolymer having at least one block derived from alkenyl arene covalently linked to at least one block derived from diene that can be dissolved in non-ester diluent oil having a saturates content of at least 90%, in the formation of a VI improver concentrate to an amount greater than the critical overlap concentration ($c_h$*), in mass %, for said linear block copolymer in said diluent oil, without raising the kinematic viscosity at 100° C. ($kv_{100}$) of the VI improver concentrate above about 3000 cSt, which method comprises adding to said concentrate at least one hydrogenated star polymer, arms of which are homopolymers or copolymers of diolefin, or copolymers of one or more conjugated diolefin and one or more monoalkenyl aromatic hydrocarbon, said star polymer being added in an amount such that the $c/c_h$* value of the star polymer in the concentrate falls within the range of from 0.01 to about 1.6, wherein c is the concentration in mass % of said star polymer in the concentrate and $c_h$* is the critical overlap concentration in mass % for said star polymer in said diluent oil.

10. The method of claim 9, wherein the diene blocks and/or alkenyl arene: blocks of said linear block copolymers are functionalized to have pendant ester, amine, imide or amide functional groups.

11. The method of claim 9, comprising the additional step of adding to said VI improver concentrate greater than 1 mass %, based on the total mass of the concentrate, of ester base stock.

12. The method of claim 11, wherein from about 5 mass % to about 60 mass %, based on the total mass of the concentrate, of ester base stock is added.

13. The method of claim 10, comprising the additional step of adding to said VI improver concentrate greater than 1 mass %, based on the total mass of the concentrate, of ester base stock.

14. The method of claim 13, wherein from about 5 mass % to about 60 mass %, based on the total mass of the concentrate, of ester base stock is added.

* * * * *